US006442971B1

(12) United States Patent
Gurevich

(10) Patent No.: US 6,442,971 B1
(45) Date of Patent: Sep. 3, 2002

(54) MULTI-STONE ROUND CENTER SETTING FOR DIAMONDS AND GEMSTONES

(75) Inventor: Zelik Gurevich, New York, NY (US)

(73) Assignee: L.I.D. Ltd., New York, NY (US)

( * ) Notice: Subject to any disclaimer, the term of this patent is extended or adjusted under 35 U.S.C. 154(b) by 0 days.

(21) Appl. No.: 09/501,113

(22) Filed: Feb. 9, 2000

(51) Int. Cl.[7] ..... A44C 17/02

(52) U.S. Cl. ..... 63/28; 63/26; 63/27; D11/91; D11/92

(58) Field of Search ..... 63/26, 27, 28; D11/91, 92

(56) References Cited

U.S. PATENT DOCUMENTS

| | | | | | |
|---|---|---|---|---|---|
| 2,887,746 | A | * | 5/1959 | Bogoff | 164/9 |
| D239,651 | S | * | 4/1976 | Hess | D11/92 |
| 5,524,458 | A | * | 6/1996 | Buchner | 63/28 |
| D338,017 | S | * | 12/1997 | Kejejian | D11/91 |
| D388,016 | S | * | 12/1997 | Kejejian | D11/91 |
| 6,003,335 | A | * | 12/1999 | Gurevich et al. | 63/26 |
| D423,397 | S | * | 4/2000 | Raviv et al. | D11/91 |
| D445,058 | S | * | 7/2001 | Kaplan | D11/91 |
| D445,355 | S | * | 7/2001 | Lai | D11/91 |

* cited by examiner

*Primary Examiner*—J. J. Swann
*Assistant Examiner*—Andrea Chop
(74) *Attorney, Agent, or Firm*—Ezra Sutton

(57) ABSTRACT

A multi-stone round setting for six substantially triangular-shaped gemstones or diamonds, each having three side walls. The multi-stone round setting includes a curved corner prong assembly having six curved prong members; six side rail members connected to the six prong members to form a substantially round-shaped setting; a central support member having six connection points and six support ledges; and six radially extending spoke members connected at their outer ends to the six prong members, respectively, and connected at their inner ends to the six connection points, respectively, to form six seating areas. Each of the six seating areas are used for receiving one of six gemstones. Each of the six triangular-shaped gemstones include three side walls, three corners, and a bottom wall, respectively, and six grooves formed in the six bottom walls, respectively. The six ledges are received within the six grooves of the bottom walls of the six gemstones, respectively, to support the six gemstones in the six seating areas. Each of the six prong members are for engaging two adjacent corners of two adjacent gemstones to keep the six gemstones seated within the six seating areas of the setting.

12 Claims, 9 Drawing Sheets

MULTI-STONE ROUND CENTER SETTING FOR DIAMONDS AND GEMSTONES

FIELD OF THE INVENTION

The present invention relates to a multi-stone round center setting for holding therein six triangular-shaped diamonds or gemstones to produce the appearance of a combined rounded gemstone aggregate providing an appearance larger than that of a single round gemstone of a similar carat weight. More particularly, this multi-stone round center setting having six gemstones therein also gives the appearance that the setting is substantially invisible.

BACKGROUND OF THE INVENTION

Invisible gemstone settings are well known in the art and refers to a setting for gemstones in which the setting lies beneath the visible surface of the gemstones. Typically, to invisibly set a large number of gemstones, the approach of the prior art has been to notch the gemstones and to mount them in a setting having two or more parallel walls, with metallic projections, for example, prongs or the like, protruding from these walls for engaging the notches. Generally, these walls define channels in which the gemstones are set abutting one another in accordance with the invisible mounting method.

Invisible gemstone settings for jewelry products suffer from a number of disadvantages. First, casting of a jewelry item with a gemstone region including a recess and walls and preparing T-shaped cross bars is a relatively difficult and therefore costly process. Second, the assembly of the jewelry item requires considerable time of a skilled worker which adds greatly to the overall cost of the jewelry item. And third, the finished jewelry item cannot be readily downsized without disturbing the invisible gemstone setting.

Therefore, there remains a need for a novel invisible and multiple gemstone round setting for jewelry ornaments which overcomes the disadvantages of conventional multi-stone and invisible gemstone settings for jewelry items. The multi-stone round center setting would include a round-shaped metal setting for holding six triangular cut gemstones in which the combined gemstone aggregate gives a larger appearance than that of a single round gemstone of a similar carat weight. Additionally, the multi-stone round center setting would give the appearance that the round setting (metal) is essentially invisible to the eye of the wearer.

DESCRIPTION OF THE PRIOR ART

Invisible gemstone settings, multi-gemstone settings, jewelry settings and the like having various designs, structures, configurations and functions have been disclosed in the prior art. For example, U.S. Pat. No. 5,848,539 to OUZOUNIAN discloses an invisible, multiple precious stone setting for mounting two or more rows of round-shaped precious stones. This prior art patent does not disclose the structure and configuration of the present invention.

U.S. Pat. No. 5,520,017 to VIVAT discloses jewelry items with invisible gemstone settings, wherein the gemstone setting includes a least two walls so as to provide at least one groove. The groove slidably receives one or more rectangularly-shaped precious stones therein. This prior art patent does not disclose the structure and configuration of the present invention.

U.S. Pat. No. 5,123,265 to RAMOT discloses an invisible gemstone setting, wherein the gemstone setting assembly includes one or more gemstones and a setting having a base formed with a plurality of ribs defining one or more sockets of polygonal configuration for receiving the gemstones. This prior art patent does not disclose the structure and configuration of the present invention.

U.S. Design Patent D403,611 to LAI discloses an ornamental design for a jewelry setting having a square-shaped pattern for square-shaped gemstones. This prior art patent does not disclose the structure and configuration of the present invention.

None of the aforementioned prior art patents disclose or teach the multi-stone round center setting of the present invention for receiving therein six triangular-shaped diamonds or gemstones which gives the appearance of a single round gemstone with the setting having an invisible profile.

Accordingly, it is an object of the present invention to provide a multi-stone round setting for holding therein six triangular-shaped gemstones in which the combined aggregate of the six gemstones gives a larger appearance than that of a single round gemstone of a similar carat weight (i.e., a 1.2 carat presentation of the combined six gemstones appears as large as a 2.0 carat round gemstone, as the present invention would have a larger table).

Another object of the present invention is to provide a multi-stone round setting having six gemstones therein that is less expensive than a single round gemstone of a similar carat weight (i.e., the 1.2 carat presentation of the combined six gemstones is less expensive than an actual 1.2 carat single round gemstone of the same carat weight).

Another object of the present invention is to provide a multi-stone round setting having six triangular cut gemstones therein which gives the appearance that the round setting is substantially invisible at distances greater than 12 inches from the jewelry product.

Another object of the present invention is to provide a multi-stone round setting that can be varied in size depending upon the total combined carat weight of the six gemstones within the round setting.

Another object of the present invention is to provide a multi-stone round setting that can be made from precious metals such as gold, silver, platinum or palladium for setting precious gemstones including diamonds, rubies, sapphires, emeralds and the like.

Another object of the present invention is to provide a multi-stone round setting having six triangular gemstones therein for use in personal adornment in the form of ornamental jewelry such as rings, pins, brooches, pendants, clasps, necklaces, bracelets, anklets and earrings.

Another object of the present invention is to provide a multi-stone round setting that can be produced in an economical manner and is readily affordable by the jewelry consumer.

SUMMARY OF THE INVENTION

In accordance with the present invention, there is provided a multi-stone round setting for six substantially triangular-shaped gemstones or diamonds, each having three side walls. The multi-stone round setting includes a curved corner prong assembly having six curved prong members; six side rail members connected to the six prong members to form a substantially round-shaped setting; a central support member having six connection points and six support ledges; and six radially extending spoke members connected at their outer ends to the six prong members, respectively, and connected at their inner ends to the six connection points, respectively, to form six seating areas. Each of the six seating areas are used for receiving one of six gemstones. Each of the six triangular-shaped gemstones include three side walls, three corners, and a bottom wall, respectively, and six grooves formed in the six bottom walls, respectively. The six ledges are received within the six grooves of the bottom walls of the six gemstones, respectively, to support the six gemstones in the six seating areas. Each of the six prong members are for engaging two adjacent comers of two adjacent gemstones to keep the six gemstones seated within the six seating areas of the setting.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT 10

Figure 1:
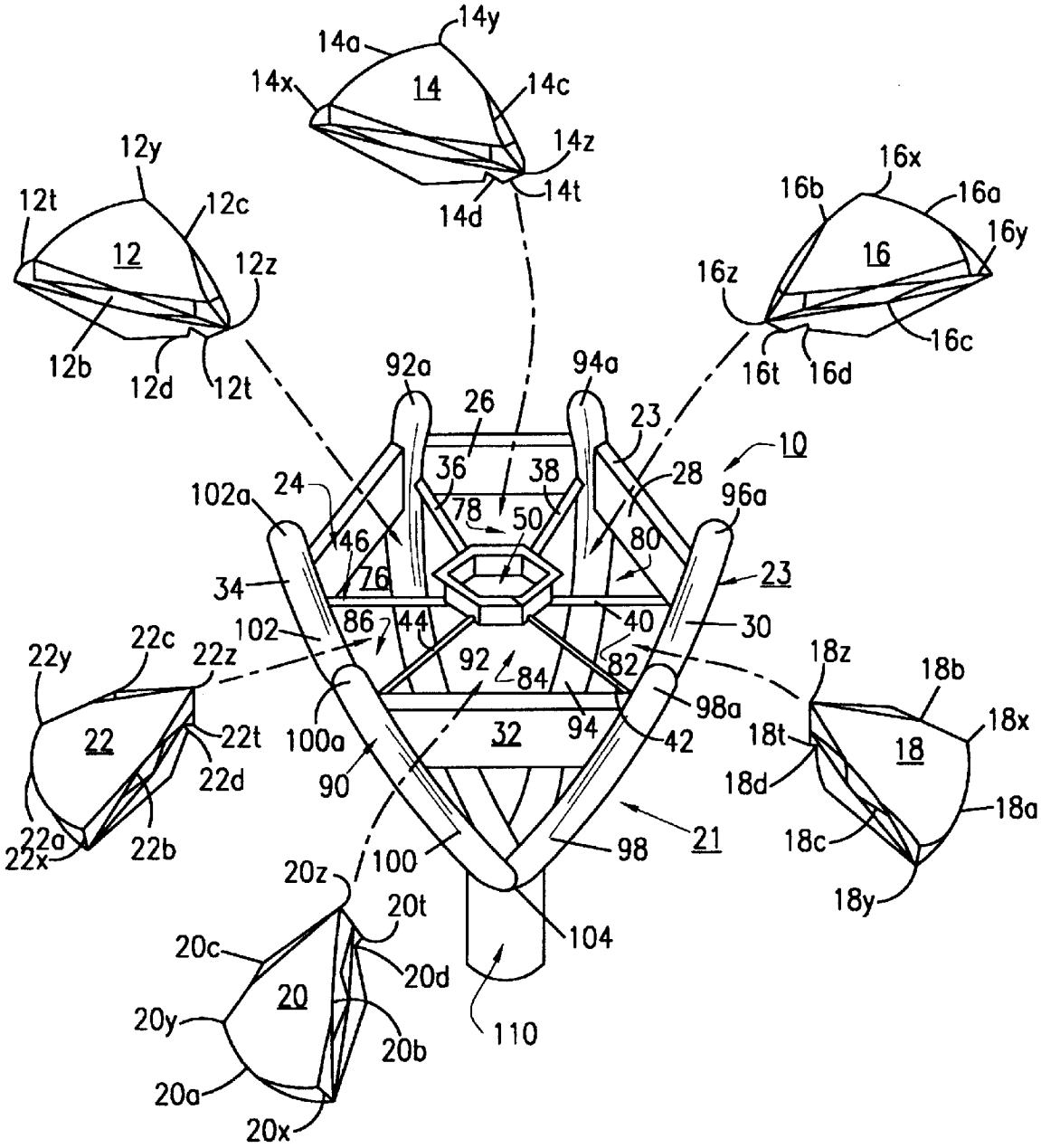
FIG. 1 is a top perspective view of the multi-stone round center setting for holding six gemstones or diamonds of the preferred embodiment of the present invention.
Figure 2:
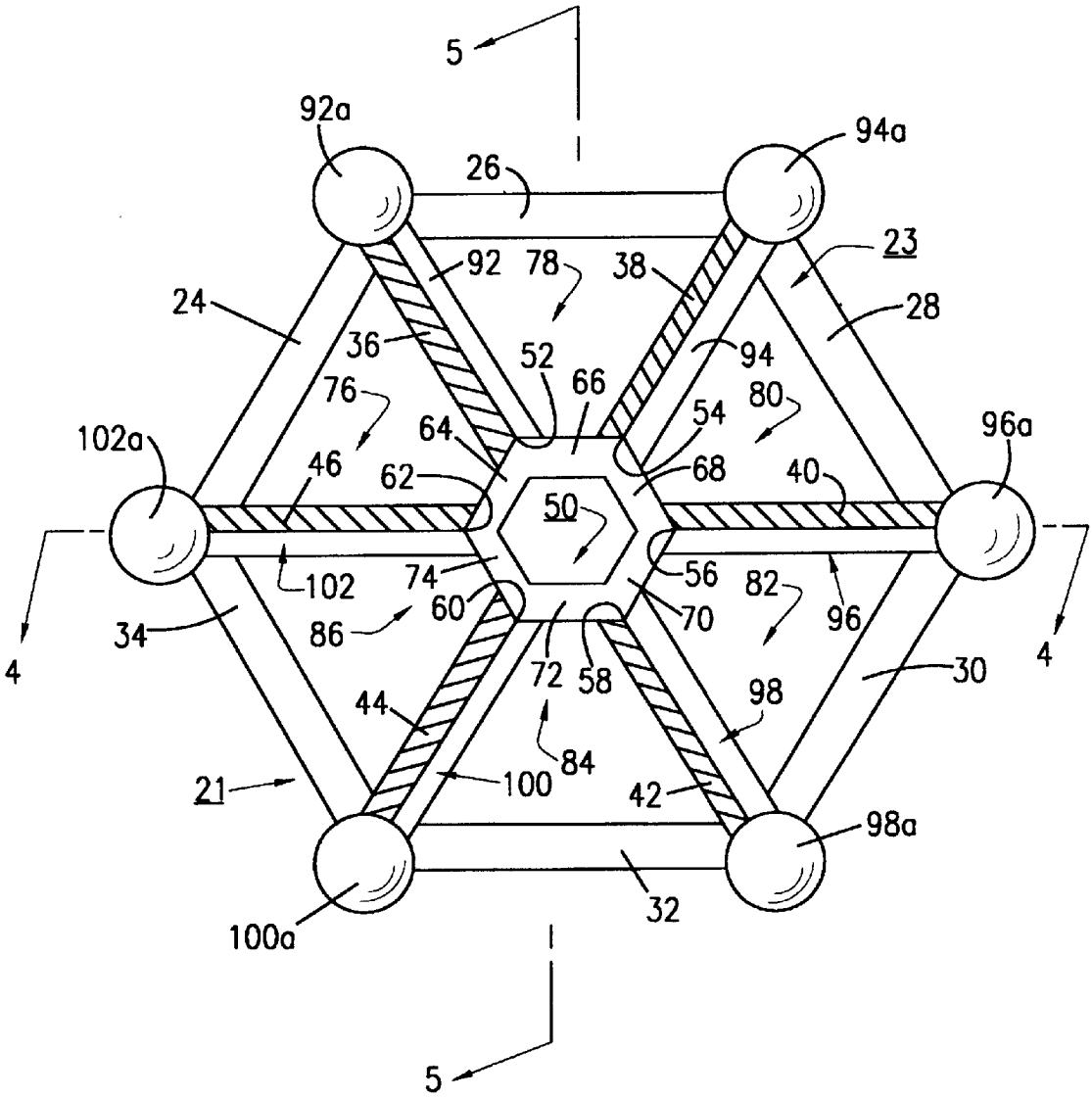
FIG. 2 is a top plan view of the multi-stone round setting of the present invention shown in FIG. 1.
Figure 3:
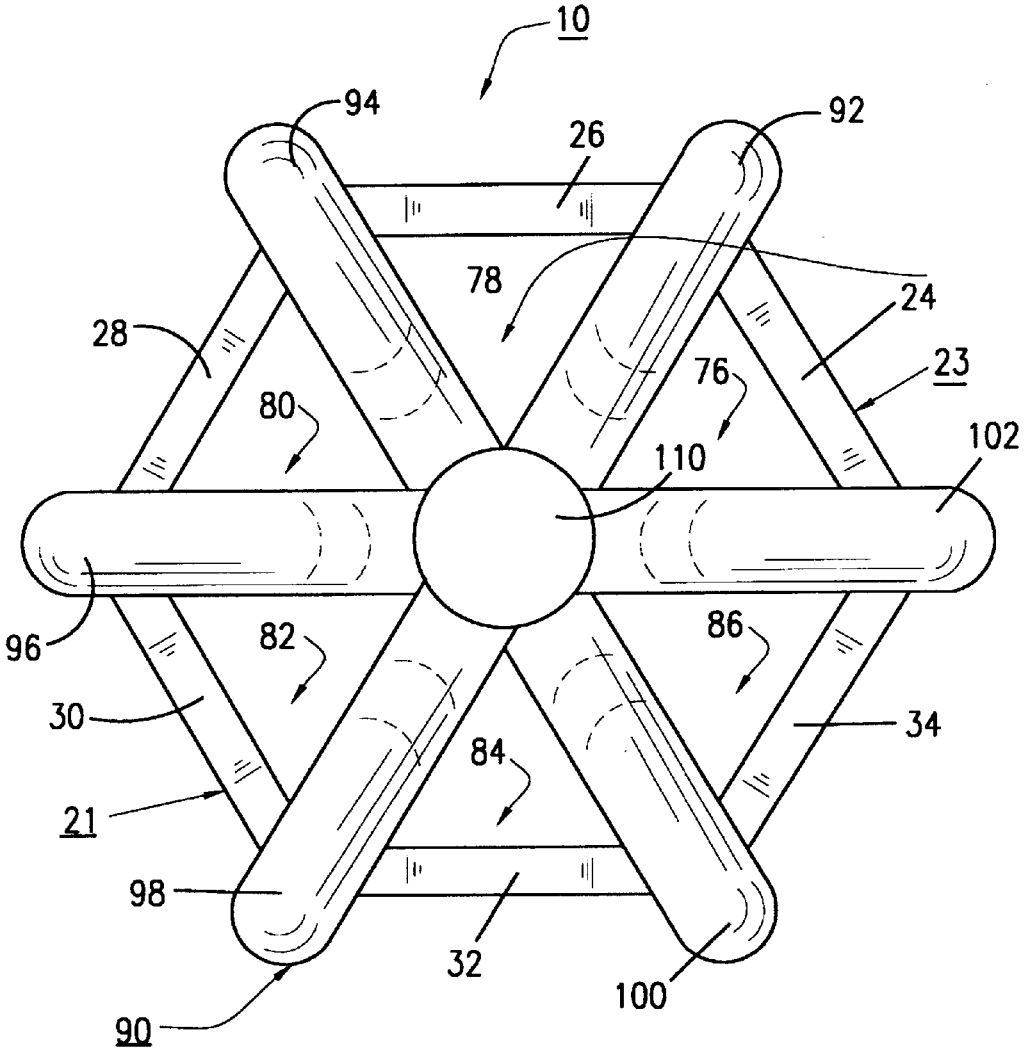
FIG. 3 is a bottom plan view of the multi-stone round setting of the present invention shown in FIG. 1.
Figure 4:
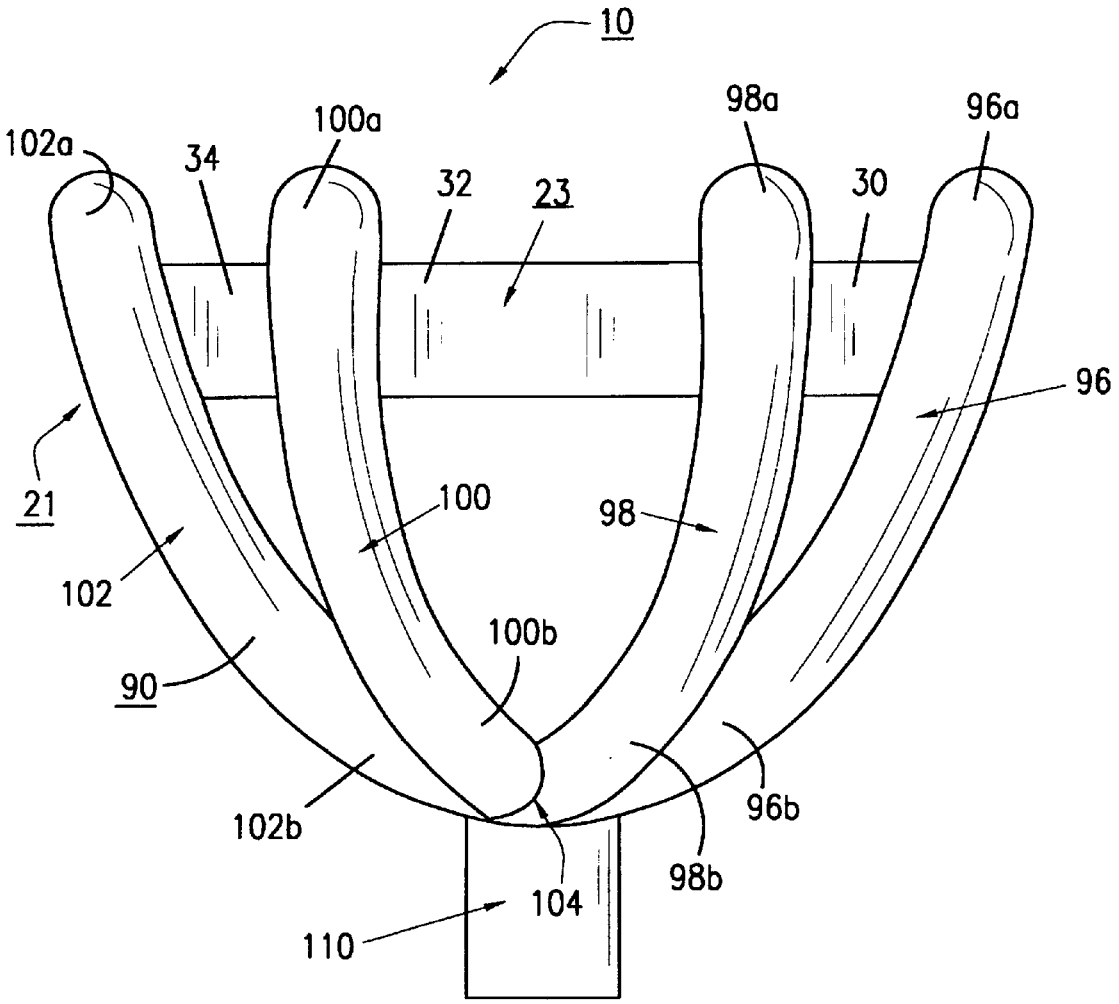
FIG. 4 is a side elevational view of the multi-stone round setting of the present invention shown along lines 4—4 in FIG. 2.
Figure 5:
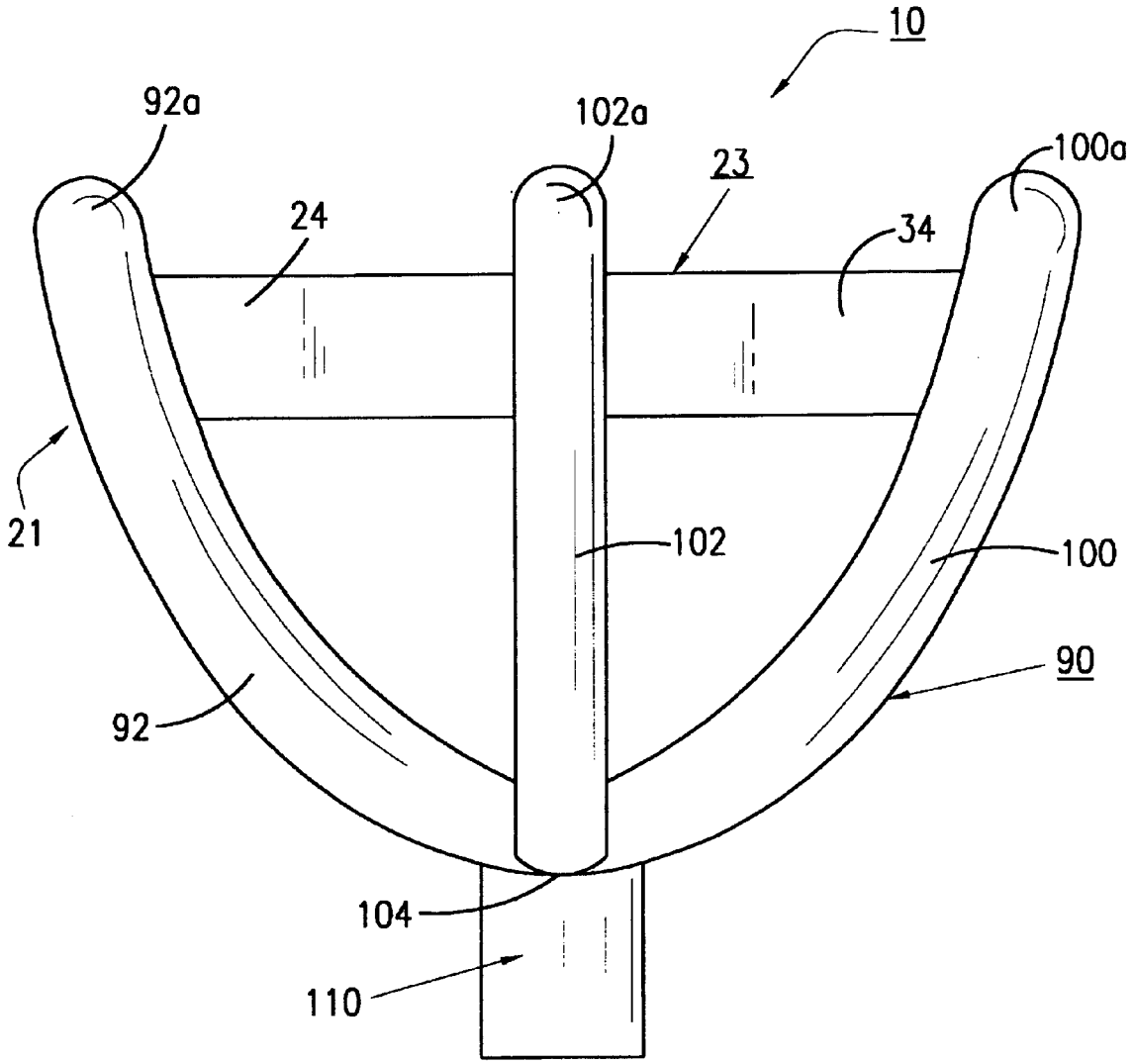
FIG. 5 is a side elevational view of the multi-stone round setting of the present invention shown along lines 5—5 in FIG. 2.
Figure 6:
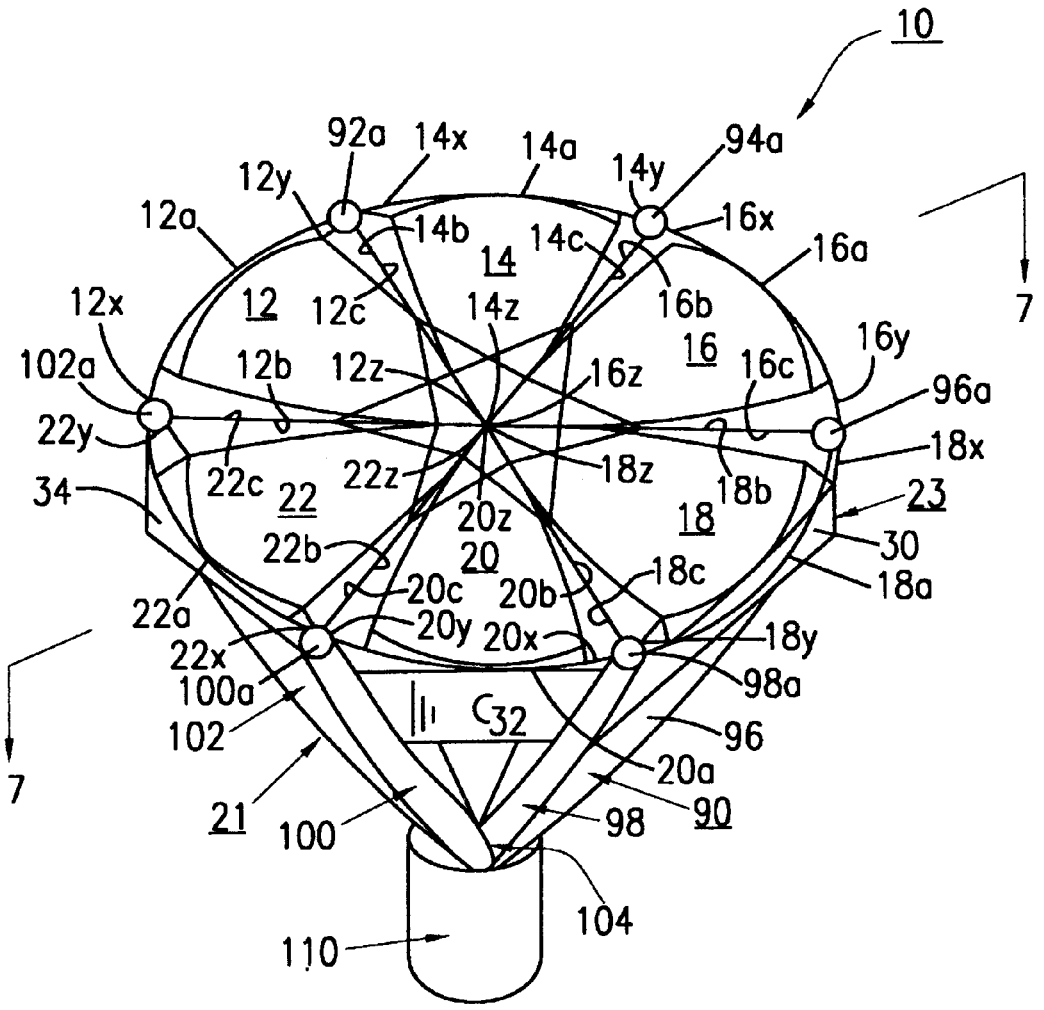
FIG. 6 is a top perspective view of the multi-stone round setting of the present invention showing six triangular-shaped diamonds seated within the six (6) seats of the round gemstone setting.
Figure 7:
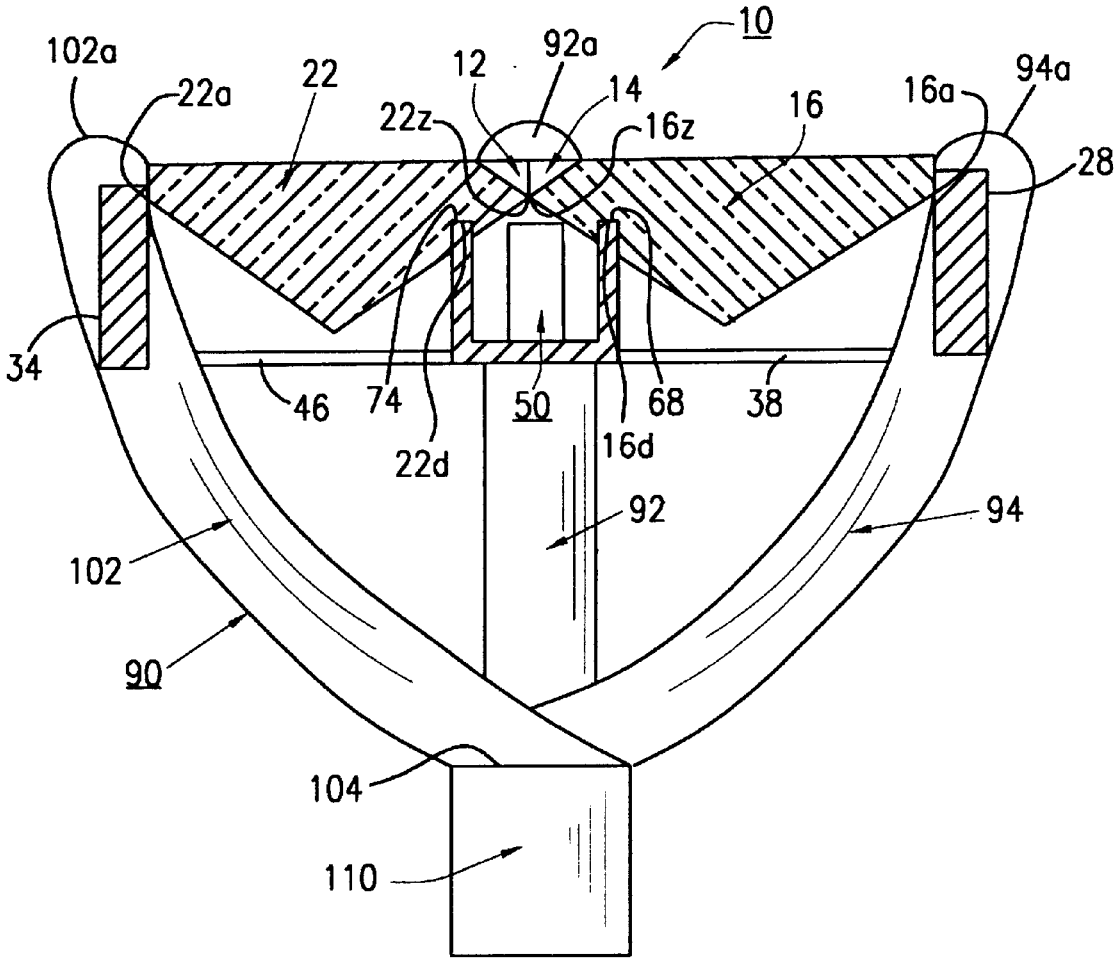
FIG. 7 is a cross-sectional view of the multi-stone round setting of the present invention taken along lines 7—7 of FIG. 6 showing the grooved slot of the diamonds being held in place on the upper ledge of the tip receiving member.

The multi-stone round center setting 10 and its component parts of the preferred embodiment of the present invention are represented in detail by FIGS. 1 through 9 of the patent drawings. The multi-stone round setting 10 is used for holding in place six (6) triangular-shaped diamonds 12, 14, 16, 18, 20 and 22 with each diamond 12 to 22 having three side walls 12*a* to 12*c*, 14*a* to 14*c*, 16*a* to 16*c*, 18*a* to 18*c*, 20*a* to 20*c* and 22*a* to 22*c*, and having three corners 12*x* to 12*z*, 14*x* to 14*z*, 16*x* to 16*z*, 18*x* to 18*z*, 20*x* to 20*z* and 22*x* to 22*z*, respectively. Additionally, each diamond 12 to 22 further includes a grooved slot 12*d*, 14*d*, 16*d*, 18*d*, 20*d* and 22*d* located at the bottom tip area 12*t*, 14*t*, 16*t*, 18*t*, 20*t* and 22*t*, respectively, of each triangular-shaped diamond 12 to 22, as shown in FIGS. 1 and 7 of the drawings. The multi-stone round setting 10, as shown in FIGS. 1 to 5 of the drawings, includes a substantially round or hexagonal-shaped (six sided) gemstone setting frame member 21 having an upper frame member 23, a central support member 50 for receiving and supporting the bottom grooved slots 12*d* to 22*d* of each diamond 12 to 22, respectively, a curved corner prong assembly 90, and a setting connecting bar member 110. The curved corner prong assembly 90 includes six (6) curved prong members 92, 94, 96, 98, 100 and 102. The six (6) side rail members 24 to 34 are connected to the six (6) prong members 92 to 102 to form a substantially round-shaped setting 10, as shown in FIG. 1 of the drawings. The central support member 50 includes six (6) connection points 52, 54, 56, 58, 60 and 62 and six (6) support ledges 64, 66, 68, 70, 72 and 74, respectively, as shown in FIG. 2 of the drawings.

The upper frame 23, as shown in FIGS. 1 and 2 of the drawings, includes the six side frame members or rail members 24, 26, 28, 30, 32 and 34, and also includes six spoke members 36, 38, 40, 42, 44 and 46 being connected at their outer ends 36*a*, 38*a*, 40*a*, 42*a*, 44*a* and 46*a* to the curved prong members 92, 94, 96, 98, 100 and 102 at location points 25, 27,29,31,33 and 35, respectively. The inner ends 36*b*,38*b*,40*b*,42*b*,44*b* and 46*b* of spoke members 36 to 46 are connected to the connection points 52, 54, 56, 58, 60 and 62 of central support member 50, respectively. Central support member 50 includes upper ledge sections 64, 66, 68, 70, 72 and 74 for receiving and supporting the bottom grooved slots 12*d* to 22*d* of each diamond 12 to 22, respectively.

Rail members 24 to 34, spoke members 36 to 46 and ledge sections 64 to 74 of support member 50 are connected with each other, as shown in FIGS. 1 and 2 of the drawings, to form six (6) seating areas 76, 78, 80, 82, 84 and 86 each having a substantially triangular shape. The six seating areas 76 to 86 are used to receive and hold in place diamonds 12 to 22, respectively, as shown in FIGS. 1 and 6 of the drawings. Seating area 76 is formed by the rail member 24, spoke members 46 and 36, and ledge section 64 of central support member 50. Seating area 78 is formed by the rail member 26, spoke members 36 and 38 and ledge section 66 of central support member 50. Seating area 80 is formed by the rail member 28, spoke members 38 and 40, and ledge section 68 of central support member 50. Seating area 82 is formed by the rail member 30, spoke members 40 and 42, and ledge section 70 of central support member 50. Seating area 84 is formed by the rail member 32, spoke members 42 and 44, and ledge section 72 of central support member 50. Seating area 86 is formed by the rail member 34, spoke members 44 and 46, and ledge section 74 of central support member 50.

The curved prong section assembly 90, as shown in FIGS. 1 and 3 to 6 of the drawings, includes curved prong members 92,94,96,98, 100 and 102 having an upper end 92*a* for engaging two adjacent corners 12*y* and 14*x* of two adjacent diamonds 12 and 14, an upper end 94*a* for engaging two adjacent corners 14*y* and 16*x* of two adjacent diamonds 14 and 16, an upper end 96*a* for engaging two adjacent corners 16*y* and 18*x* of two adjacent diamonds 16 and 18, an upper end 98*a* for engaging two adjacent corners 18*y* and 20*x* of two adjacent diamonds 18 and 20, an upper end 100*a* for engaging two adjacent diamonds 20 and 22, and an upper end 102*a* for engaging two adjacent corners 22*y* and 12*x* of two adjacent diamonds 22 and 12.

Figure 8:
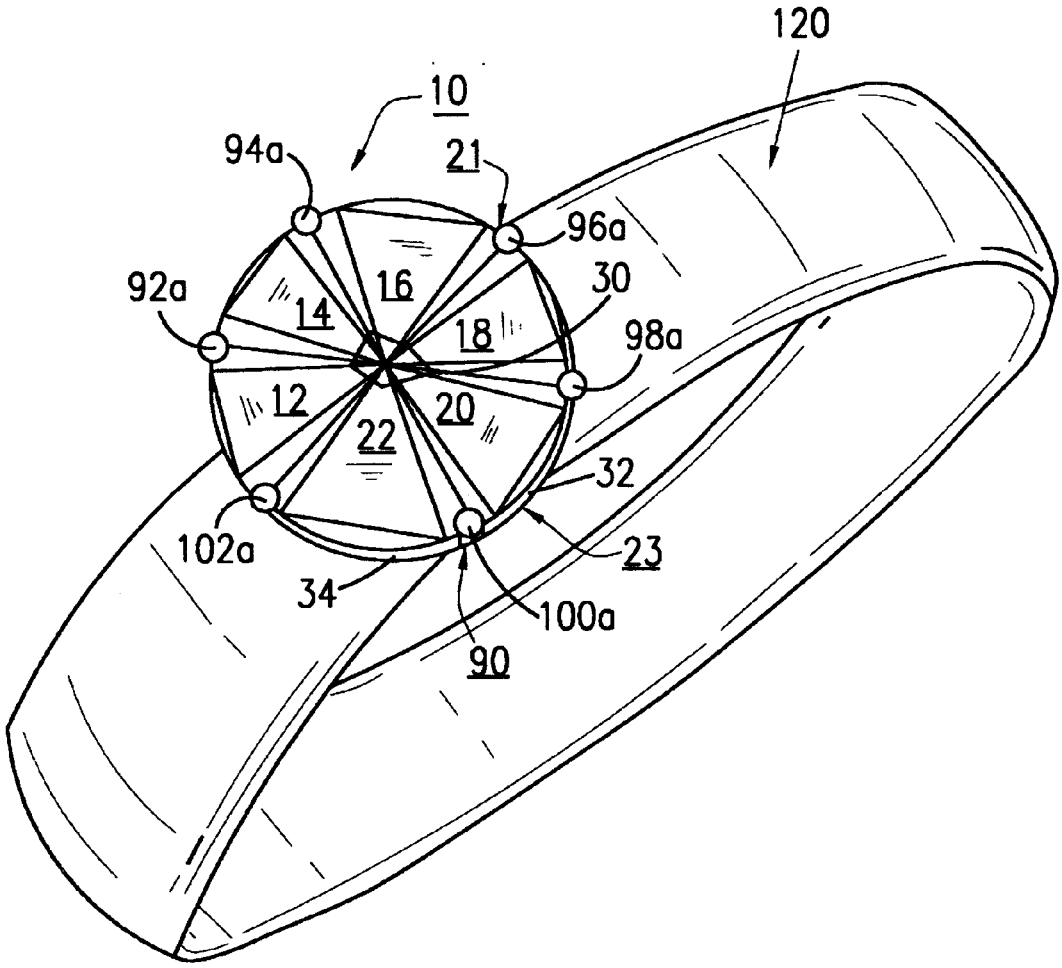
FIG. 8 is a top perspective view of the multi-stone round setting of the present invention showing six triangular-shaped diamonds seated within the six seats of the round gemstone setting and being connected to a ring holding member to form a diamond ring.

Curved prong members 92 to 102 also have lower ends 92*b*, 94*b*, 96*b*, 98*b*, 100*b* and 102*b* being attached and joined together at the bottom end point 104. The setting connecting bar member 110 is also integrally attached at the bottom end point 104. Connecting bar member 110 is used for attachment to a ring member 120 or other jewelry products such as pins 122, brooches, pendants, clasps, necklaces, bracelets, anklets and earrings, as shown in FIGS. 8 and 9 of the drawings.

The gemstone setting 10 can be made of gold, silver, platinum, palladium, or other precious metals. Gemstone setting 10 can also be made into different size settings depending upon the size (carat weight) of the triangular-shaped diamonds 12 to 22 being mounted therein. The total carat weight for the six triangular-shaped gemstones or diamonds 12 to 22 typically is in the range of 0.16 to 2.0 carats per gemstone setting 10. Additionally, other types of gemstones such as rubies, emeralds and sapphires can be used for the multi-stone round setting 10 of the present invention.

DETAILED DESCRIPTION OF THE ALTERNATE EMBODIMENT 200

Figure 9:
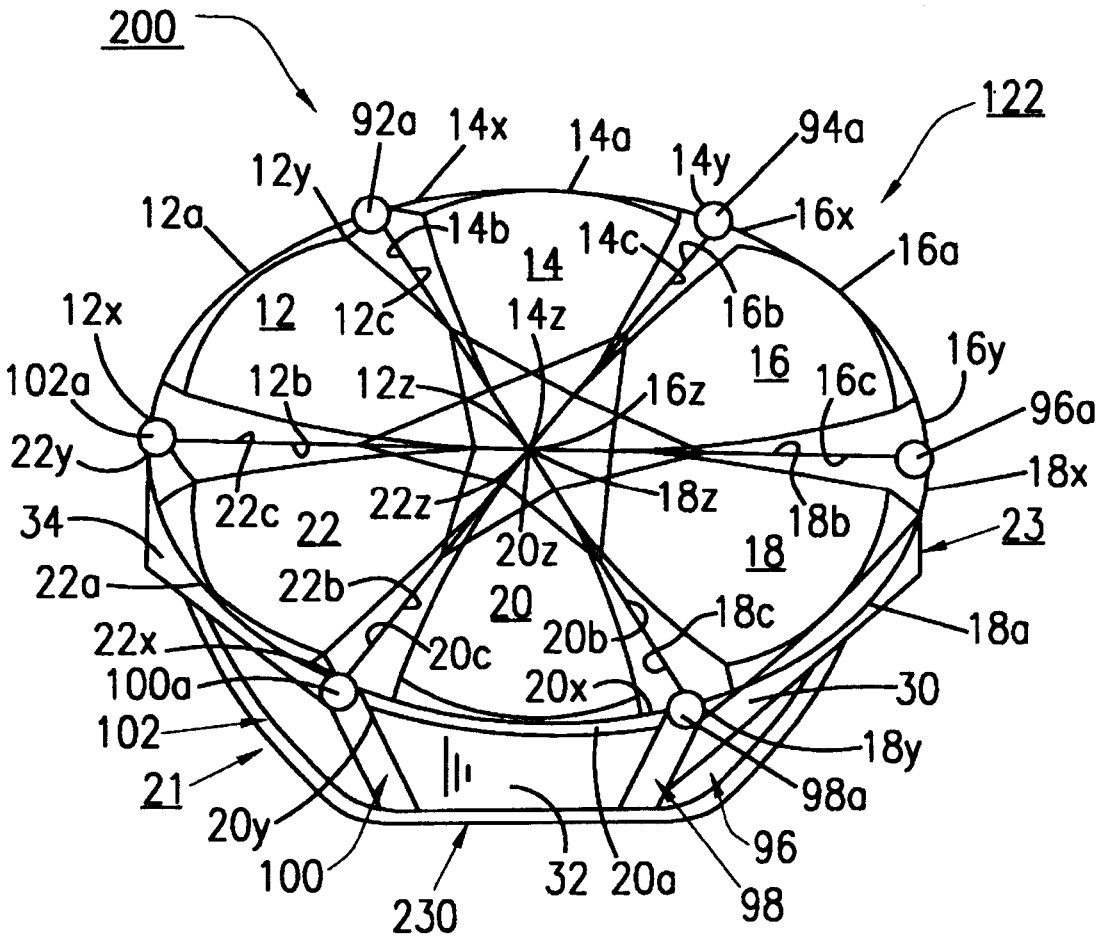
FIG. 9 is a top perspective view of the multi-stone round setting of the present invention showing six triangular-shaped diamonds seated within the six seats of the round setting for forming a pin.

In an alternate embodiment 200, as shown in FIG. 9, the multi-stone round setting 210, includes a setting frame member 220 having an upper frame member 222. All other component parts are exactly the same as the preferred embodiment of the multi-stone round setting 10 except for a plate member 230 being attached to the upper ends 92*a* to 102*a* of curved stem members 92 to 102, respectively. Plate member 230 is used for connecting a pin device (not shown) or latch device (not shown) in order to make a pin 122 or brooch or an earring piece of jewelry.

OPERATION OF THE PRESENT INVENTION

The operation of the multi-stone round setting 10 of the preferred embodiment of the present invention, as shown in FIGS. 1, 6, 9 and 10 of the patent drawings, starts with the jeweler initially mounting the connecting bar member 110 to a jewelry vise (not shown) for the convenient assembly of each of the diamonds 12 to 22 within each of the seats 76 to 86, respectively, of gemstone round setting 10 by the jeweler. The jeweler's initial steps are slidably setting the cut grooves (grooved slots) 12*d* and 18*d* of diamonds 12 and 18 onto the upper ledge sections 64 and 70, respectively, of central support member 50, as shown in FIG. 1 of the drawings. The jeweler then slightly bends inwardly two of the upper ends 102*a* and 92*a* of curved stems 102 and 92, respectively, as well as, slightly bends inwardly two of the upper ends 96*a* and 98*a* of curved stems 96 and 98, respectively, in order to firmly hold diamonds 12 and 18 within seats 76 ad 82, respectively, of the multi-stone round setting 10, as shown in FIGS. 1, 6 and 7 of the drawings.

The jeweler now repeats the aforementioned steps for diamonds 14 and 20 by slidably setting the grooved slots 14*d* and 20*d* of diamonds 14 and 20 onto the upper ledge sections 66 and 72, respectively, of support member 50, as shown in FIG. 1 of the drawings. The jeweler now repeats one more time the aforementioned steps for diamonds 16 and 22 by slidably setting the grooved slots 16*d* and 22*d* of diamonds 16 and 22 onto the upper ledge sections 68 and 74, respectively, of support member 50, as shown in FIG. 1 of the drawings.

The jeweler then slightly bends inwardly the remaining two upper ends 94*a* and 100*a* of curved sections 94 and 100, respectively, in order to firmly hold diamonds 14, 16, 20 and 22 within seats 78, 80, 84 and 86, respectively, of the multi-stone round setting 10, as depicted in FIGS. 6, 8 and 9 of the drawings.

The jeweler's final step is to attach the connecting bar member 110 to a ring holding member 120 to form a finger ringer, as shown in FIG. 8 of the drawings.

ADVANTAGES OF THE PRESENT INVENTION

Accordingly, an advantage of the present invention is that it provides for a multi-stone round setting for holding therein six triangular-shaped gemstones in which the combined aggregate of the six gemstones give a larger appearance than that of a single round gemstone of a similar carat weight (i.e., a 1.2 carat presentation of the combined six gemstones appears as large as a 2.0 carat round gemstone, as the present invention would have a larger table).

Another advantage of the present invention is that it provides for a multi-stone round setting having six gemstones therein that is less expensive than a single round gemstone of a similar carat weight (i.e., the 1.2 carat presentation of the combined six gemstones is less expensive than an actual 1.2 carat single round gemstone of the same carat weight).

Another advantage of the present invention is that it provides for a multi-stone round setting having or six triangular cut gemstones therein which gives the appearance that the round setting is substantially invisible at distances greater than 12 inches from the jewelry product.

Another advantage of the present invention is that it provides for a multi-stone round setting that can be varied in size depending upon the total combined carat weight of the six gemstones within the round setting.

Another advantage of the present invention is that it provides for a multi-stone round setting that can be made from precious metals such as gold, silver, platinum or palladium for setting precious gemstones including diamonds, rubies, sapphires, emeralds and the like.

Another advantage of the present invention is that it provides for a multi-stone round setting having six triangular gemstones therein for use in personal adornment in the form of ornamental jewelry such as rings, pins, brooches, pendants, clasps, necklaces, bracelets, anklets and earrings.

Another advantage of the present invention is that it provides for a multi-stone round setting that can be produced in an economical manner and is readily affordable by the jewelry consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A multi-stone round setting in combination with six substantially triangular-shaped gemstones or diamonds, each having three side walls, comprising:

a) a curved corner prong assembly having six curved prong members;

b) six side rail members connected to said six prong members to form a substantially round-shaped setting;

c) a central support member having six connection points and six support ledges;

d) six radially-extending spoke members connected at their outer ends to said six prong members, respectively, and connected at their inner ends to said six connection points, respectively, to form six seating areas;

e) said six seating areas each for receiving one of six gemstones;

f) said six triangular-shaped gemstones each having three side walls, three corners, and a bottom wall, respectively, and six grooves formed in said six bottom walls, respectively;

g) said six ledges being received within said six grooves of said six bottom walls, respectively, to support said six gemstones in said six seating areas; and h) each of said six prong members for engaging two adjacent corners of two adjacent gemstones to keep said six gemstones seated within said six seating areas of said setting.

2. A multi-stone round setting in accordance with claim 1, wherein each of said six seating areas is defined by one of said side rail members being connected to two of said spoke members which are connected to said central support member.

3. A multi-stone round setting in accordance with claim 2, wherein said central support member includes six side walls of said support member connected to said six support ledges, respectively, and each of said spoke members being connected to said six side walls at said six connection points.

4. A multi-stone round setting in accordance with claim 1, wherein said six seating areas each have a triangular shape for receiving said triangular-shaped gemstones.

5. A multi-stone round setting in accordance with claim 1, wherein said six prong members each have upper ends, and wherein the upper ends of said six prong members are higher than said six side rail members for directly engaging said adjacent corners of said six gemstones.

6. A multi-stone round setting in accordance with claim 1, wherein said six prong members curve inwardly and are joined together at a bottom end point.

7. A multi-stone round setting in accordance with claim 6, wherein said bottom end point is integrally attached to a connecting bar member for attachment to a jewelry holding member for forming a piece of jewelry.

8. A multi-stone round setting in accordance with claim 7, wherein said connecting bar member is attached to a jewelry holding member to form a ring, a pin, a brooch, a pendant, a clasp, a necklace, a bracelet, an anklet or earrings.

9. A multi-stone round setting in accordance with claim 7, further including a plate member having an outer perimeter edge, said plate member being connected to said jewelry holding member for forming a ring, a pin, a brooch, a pendant, a clasp, a necklace, a bracelet, an anklet or earrings.

10. A multi-stone round setting in accordance with claim 9, wherein said curved corner prong assembly has said six curved corner prong members terminated in relationship to said bottoms of said six gemstones; said terminated curved prong members being attached to said outer perimeter edge of said plate member.

11. A multi-stone round setting in accordance with claim 1, wherein said multi-stone round setting is made from gold, silver, platinum, palladium, or precious metals.

12. A multi-stone round setting in accordance with claim 1, wherein said the six gemstones have a total weight being in the range of 0.16 to 2.0 carats.

* * * * *